US008628646B2

(12) United States Patent
Berlin et al.

(10) Patent No.: US 8,628,646 B2
(45) Date of Patent: Jan. 14, 2014

(54) GROOVED ANODE FOR ELECTROLYSIS CELL

(75) Inventors: Geoffrey Berlin, Lemon Tree Passage (AU); Jean Camire, Hamilton South (AU); Daran Emmett, Medowie (AU); Yvan Foster, Newcastle (AU); Guillaume Servant, Cooks Hill (AU); Christian Jonville, Corenc (FR); Malcolm Manwaring, Aberglasslyn (AU)

(73) Assignee: Rio Tinto Alcan International Limited, Montreal, Quebec (CA)

( * ) Notice: Subject to any disclaimer, the term of this patent is extended or adjusted under 35 U.S.C. 154(b) by 178 days.

(21) Appl. No.: 13/387,575

(22) PCT Filed: Jul. 21, 2010

(86) PCT No.: PCT/FR2010/000526

§ 371 (c)(1), (2), (4) Date: Jan. 27, 2012

(87) PCT Pub. No.: WO2011/015718

PCT Pub. Date: Feb. 10, 2011

(65) Prior Publication Data

US 2012/0125784 A1 May 24, 2012

(30) Foreign Application Priority Data

Jul. 29, 2009 (FR) ..... 09 03722

(51) Int. Cl.

| | |
|---|---|
| ***C25C 3/12*** | (2006.01) |
| ***C25C 7/02*** | (2006.01) |
| ***B28B 1/08*** | (2006.01) |

(52) U.S. Cl.
USPC ..... 204/280; 204/294; 204/243.1; 205/372; 205/391; 264/71

(58) Field of Classification Search
USPC ..... 205/372, 391
See application file for complete search history.

(56) References Cited

U.S. PATENT DOCUMENTS 6,409,894 B1 6/2002 Boucard
7,179,353 B2 * 2/2007 Barclay et al. ..... 204/246

(Continued)

FOREIGN PATENT DOCUMENTS

AU 2008327757 B2 12/2011
CN 201704421 U * 1/2011 ..... C25C 3/12

(Continued)

OTHER PUBLICATIONS

International Search Report mailed Nov. 18, 2010 (PCT/FR2010/000526); ISA/EP.

(Continued)

*Primary Examiner* — Harry D Wilkins, III
(74) *Attorney, Agent, or Firm* — Banner & Witcoff, Ltd.

(57) ABSTRACT

The subject of the invention is an anode block (13, 13*a*-13*e*) made of carbon for a pre-baked anode (4) for use in a metal electrolysis cell (1) comprising a higher face (24), a lower face (23), designed to be laid out opposite a higher face of a cathode (9), and four side faces (21,22,34), and including at least one first groove (31*a*-31*e*) leading onto at least one of the side faces, in which the first groove has a maximum length $L_{max}$ in a plane parallel to the lower face, and characterized in that the first groove does not lead onto said lower or higher faces, or leads onto said lower or higher faces over a length $L_0$ less than half the maximum length $L_{max}$.

17 Claims, 4 Drawing Sheets

(56) References Cited

U.S. PATENT DOCUMENTS

| | | | | |
|---|---|---|---|---|
| 7,384,521 | B2 * | 6/2008 | Wang et al. | 204/294 |
| 7,799,189 | B2 * | 9/2010 | Barclay et al. | 204/294 |
| 7,820,027 | B2 * | 10/2010 | Barclay et al. | 205/376 |
| 7,901,560 | B2 * | 3/2011 | Storesund | 205/380 |
| 2005/0199488 | A1 | 9/2005 | Barclay et al. | |
| 2007/0045104 | A1 | 3/2007 | Wang et al. | |

FOREIGN PATENT DOCUMENTS

| | | | |
|---|---|---|---|
| FR | 2806742 | A1 | 9/2001 |
| GB | 923344 | A | 4/1963 |
| WO | 2006137739 | A1 | 12/2006 |
| WO | 2009066025 | A2 | 5/2009 |

OTHER PUBLICATIONS

Light metals 2007 p. 299-304 "Development and deployment of slotted anode technology at Alcoa", Xiangwen Wang et al.

Light Metals 2005 "Energy saving in Hindalco's Aluminum Smelter", S.C. Tandon & R.N. Prasad.

Light metals 2007 p. 305-310 "The impact of slots on reduction cell individual anode current variation", Geoff Bearne, Dereck Gadd, Simon Lix.

* cited by examiner 1
3
5
16
14
12
4
15
13
19
17
8
18
11
9
6
10
7
2

GROOVED ANODE FOR ELECTROLYSIS CELL

CROSS-REFERENCE TO RELATED APPLICATIONS

The present application is a U.S. National Phase filing of International Application No. PCT/FR2010/000526 filed on Jul. 21, 2010, designating the United States of America and claiming priority to France Patent Application No. 0903722, filed Jul. 29, 2009. The present application claims priority to and the benefit of all the above-identified applications, and all the above-identified applications are incorporated by reference herein in their entireties.

SCOPE OF THE INVENTION

The invention relates to the production of aluminum by igneous electrolysis using the Hall-Héroult process, and more particularly the pre-baked anodes used in aluminum production plants and comprising an anode block made of carbon, a manufacturing process for such anode blocks and a device designed for the manufacture of such anode blocks.

BACKGROUND OF RELATED ART

Metallic aluminum is produced industrially by igneous electrolysis, namely by electrolysis of alumina in solution in a molten cryolite bath, known as an electrolysis bath, using the well-known Hall-Héroult process. The electrolysis bath is contained in cells which comprise a steel container coated on the inside with refractory and/or insulating materials, and cathodic elements located at the bottom of the cell. Anode blocks made of carbonaceous material are partially immersed in the electrolysis bath. Each tank and the corresponding anodes form what is often called an electrolysis cell. The electrolysis current, which circulates in the electrolysis bath, and possibly a layer of liquid aluminum via the anodes and the cathodic elements, causes the reduction reactions of alumina and also makes it possible to maintain the electrolysis bath at a temperature of about 950° C. by Joule effect.

French patent application FR 2.806.742 (corresponding to American U.S. Pat. No. 6,409,894) describes installations in an electrolysis plant designed for the production of aluminum.

According to the most widespread technology, the electrolysis cells comprise a plurality of anodes said to be "pre-baked", made of carbonaceous material. These are consumed during the aluminum electrolytic reduction reactions.

Gases, especially carbon dioxide, are generated during the electrolysis reactions and naturally accumulate in the form of gas bubbles under the generally substantially flat and horizontal lower surface of the anode, which influences the overall stability of the cell.

The accumulation of these gas bubbles causes:

- electrical variations and instabilities,
- a high frequency and long duration of anode effects,
- an increased possibility of the opposite reaction and therefore a loss of productivity because of the short distance between the layer of aluminum produced and the $CO_2$ bubbles,
- an increased consumption of carbon and the formation of harmful gases because of the transformation of $CO_2$ as it comes into contact with the carbon.

The use of pre-baked anodes with carbonaceous anode blocks comprising one or more grooves in their lower part is known; these facilitate the removal of the gas bubbles and prevent them from building up in order to solve the problems stated above and to reduce energy consumption, as shown in Light Metals 2005 "Energy saving in Hindalco's Aluminum Smelter", S. C. Tandon & R. N. Prasad. The grooves make it possible to decrease the average free path of the gas bubbles under the anode to get out from the space between the electrodes and thereby to reduce the size of the bubbles which are formed under the anode.

The value of the use of grooves has already been studied and proven, for example in Light metals 2007 p. 305-310 "The impact of slots on reduction cell individual anode current variation", Geoff Bearne, Dereck Gadd, Simon Lix, or Light metals 2007 p. 299-304 "Development and deployment of slotted anode technology at Alcoa", Xiangwen Wang et al.

It is also known, from the following documents:

WO 2006/137739, to use finer grooves (about 2 to 8 mm) than those commonly used (about 8 to 20 mm) so as to optimize the useful carbonaceous mass and the exchange surface;

U.S. Pat. No. 7,179,353, to use an anode block comprising grooves leading to a single side or side surface of the anode block, and more particularly towards the center of the electrolysis cell so as to improve alumina dissolution.

A well-known limit to the use of these grooves results from the fact that the depth of the grooves from the lower surface of the anode blocks is limited in order not to disturb the mechanical and physical intactness of the carbonaceous anode blocks. However the carbonaceous anode blocks are gradually consumed during the electrolysis reaction over a height greater than the depth of the grooves so that the duration of the grooves of an anode is shorter than the lifespan of the anode. Consequently, for a certain amount of time during the lifespan of the anodes the lower part of the anode blocks no longer has any groove. The problems stated above for anodes without grooves then become noticeable.

As stated in Light metals 2007 p. 299-304 "Development and deployment of slotted anode technology at Alcoa", the depth of the grooves is limited for reasons of intactness mainly in the case of grooves formed by molding on crude anode blocks so that the beneficial effects resulting from the presence of the grooves can be observed only during part of the lifespan of the anodes. The grooves create weaknesses in the crude anode blocks which then split during transport, storage or baking.

In practice it also proves difficult and expensive to reliably obtain by sawing baked anode blocks anodes with grooves as deep as the height of the anode block that will be consumed. The mechanical strains and vibrations exerted by sawing blades cause the carbon blocks to crumble, craze, and then burst. Anode sawing additionally proves to be an expensive exercise, particularly on account of the high cost of the sawing equipment, the large amount of energy required, and the collection and treatment of the powders produced by sawing.

The dimensions of the anode blocks for anodes commonly used are of about 1200 to 1700 mm in length, 500 to 1000 mm in width and 550 to 700 mm in height, with one to three grooves of a depth generally ranging between 150 and 350 mm.

For a 600 mm high anode block with a height of consumable carbon of 400 mm and a 250 mm deep groove, the groove produces a beneficial effect during only 62.5% of the lifespan of the anode.

A first aim of the invention is to propose another type of anode to solve the problems of removing the gas building up under the anodes without compromising the intactness of the anode blocks while they are being manufactured, stored, transported or used.

Another aim of the invention is to propose anodes making it possible to cure the disadvantages stated above, i.e. to propose anodes producing a beneficial effect for a greater length of time without compromising the intactness of the anode blocks while they are being manufactured, stored, transported or used.

DESCRIPTION OF THE INVENTION

To this end, the subject of the invention is an anode block made of carbon for a pre-baked anode for use in a metal electrolysis cell comprising a higher face, a lower face, designed to be laid out opposite a higher face of a cathode, and four side faces, and including at least one first groove leading to at least one of the side faces, in which the first groove has a maximum length $L_{max}$ in a plane parallel to the lower face, and characterized in that the first groove does not lead to the lower or higher faces, or leads to said lower or higher faces over a length $L_o$ less than half the maximum length $L_{max}$.

In other words, the first groove according to the invention forms a recess in the heart of the material making up the anode block which is not open onto the lower or higher faces over part of the length of said groove.

The higher face of the anode block additionally comprises at least one fitting recess, and the lower face of the anode block is designed when in use to be immersed in an electrolysis bath. "Groove" is taken to mean, as is known from prior art, an extended, substantially vertical recess of depth ranging between 50 and 500 mm and of width ranging between 5 and 40 mm.

Such a first groove has the effect of reducing the turbulence of the electrolysis bath and the kinetic energy of turbulence for the volume located below the lower face of the anode block, when it leads onto a significant length on the lower face, i.e. after a certain amount of wear of the anode block. The reduction in turbulence is particularly beneficial in the area below the anode block because it reduces the re-oxidation of metal dissolved in the electrolysis bath.

Such a first groove preserves the structural intactness of the anode block and therefore its physical resistance owing to the fact that the essential part of the first groove is formed in the heart of the material. The outer envelope, which has a greater propensity to undergo strain and to be split than the heart of material, is then weakened to a lesser extent with such a first groove which has less surface leading onto the outer faces of the anode block as compared to a groove known from prior art.

The groove leads onto a single lateral side or two opposite lateral sides of the anode block to facilitate removal of the gas building up under the anode block.

According to a particular embodiment of the invention, the groove may have a bottom that is slightly tilted by an angle of less than 10° in relation to the horizontal, to improve gas removal and to direct this removed gas to a predetermined place in the cell, for example to the points where alumina is loaded so as to facilitate stirring and dissolution of the alumina, and more particularly towards a central corridor in the electrolysis cell.

The special and innovative shape of the first groove according to the invention endows it with a period of full efficiency that is out of step with the grooves of prior art formed from the lower face. As the first groove does not lead onto the lower face or leads onto the lower face over a short length, it is ineffective, or of limited effectiveness, for gas removal in the first moments that the anode block is immersed in the electrolysis cell. The first groove becomes fully effective after a certain amount of wear of the anode block, when the length of groove leading onto the lower face increases.

The association of at least one first groove with at least one second groove from prior art in an anode block for anode is therefore particularly advantageous. "Second groove" is taken to mean a groove of maximum length $L'_{max}$ in a plane parallel with the lower face and leading onto the lower face over a length $L'_0$ equal or substantially equal to $L'_{max}$, for example when the lower edge of the anode block is chamfered.

So when a new anode is fitted in an electrolysis cell, the second groove allows the removal of gas building up under the anode and when the second groove disappears as a result of wear of the anode block, the first groove takes over for the removal of gas building up under the anode. The periods of effectiveness of the first and second grooves may overlap, i.e. the first and second grooves may coexist at the same depth in relation to the lower face, or they may be slightly separate.

The anode block may include one or more first grooves and one or more second grooves. The direction of the various grooves may vary; the first grooves may, for example, be perpendicular to the second grooves.

So as compared to an anode block from prior art, for which carbon consumption or wear caused the move from an effective groove to no groove, with the anode blocks according to the invention comprising at least one first groove and at least one second groove, there is a move from a second groove to a first groove, which avoids disturbances and abrupt changes in fluid kinetics with the related problems of electrical equilibrium, and facilitates, for example, adaptive adjustments.

According to an example of a particularly advantageous embodiment of the invention, the anode block comprises two second grooves and one first groove, the first and the second grooves extending in parallel in the longitudinal direction from the anode block and the first groove being laid out halfway between the two second grooves. Offsetting the first groove in a plane parallel with the lower face, in relation to the two second grooves therefore allows optimal conservation of the physical intactness of the anode block.

According to an advantageous embodiment, length $L_o$ over which the first groove leads onto the lower face is less than 25% of the maximum length $L_{max}$ and preferably less than 10% the maximum length $L_{max}$. The lower the length $L_0$ over which the first groove leads onto the lower face, the greater the physical intactness of the anode block. So a preferred example of an embodiment will correspond to the case in which the groove does not lead onto the lower face. The fact that the first groove leads onto the lower face results mainly from a manufacturing process that is particularly advantageous because it is simple to implement, in which:

- a blade is inserted inside a vibrocompactor mold;
- the vibrocompactor mold is loaded with carbonaceous materials that make up the anode block;
- the carbonaceous materials are vibrocompacted; and
- the anode block formed in this way is removed from the mold, in particular by slippage in relation to the blade.

According to another embodiment, the anode block is removed from the mold after withdrawing the blade from the mold.

According to an advantageous embodiment of the invention, the blade is fixed to the bottom of the mold before loading.

According to another advantageous embodiment of the invention, the blade is fixed to one lateral face or two opposed lateral faces of the mold before loading The invention extends to anodes with at least one anode block as described above and a fixing rod.

The invention also extends to a cell for the production of aluminum by igneous electrolysis comprising at least one anode as described above, and to a process for the manufacture of aluminum including the stages consisting of:

providing at least one anode as defined above;

fitting the anode in an aluminum electrolysis cell;

sending current into the electrolysis cell through the anode;

recovering the aluminum obtained by electrolysis in the bottom of the electrolysis cell.

The invention is described in greater detail below using the annexed figures.

DETAILED DESCRIPTION OF THE INVENTION

Electrolysis plants for the production of aluminum include a liquid aluminum production area containing one or more electrolysis halls containing electrolysis cells. The electrolysis cells are normally laid out in lines or files, each line or file comprising typically more than a hundred cells, and electrically connected in series using connection conductors.

Figure 1:
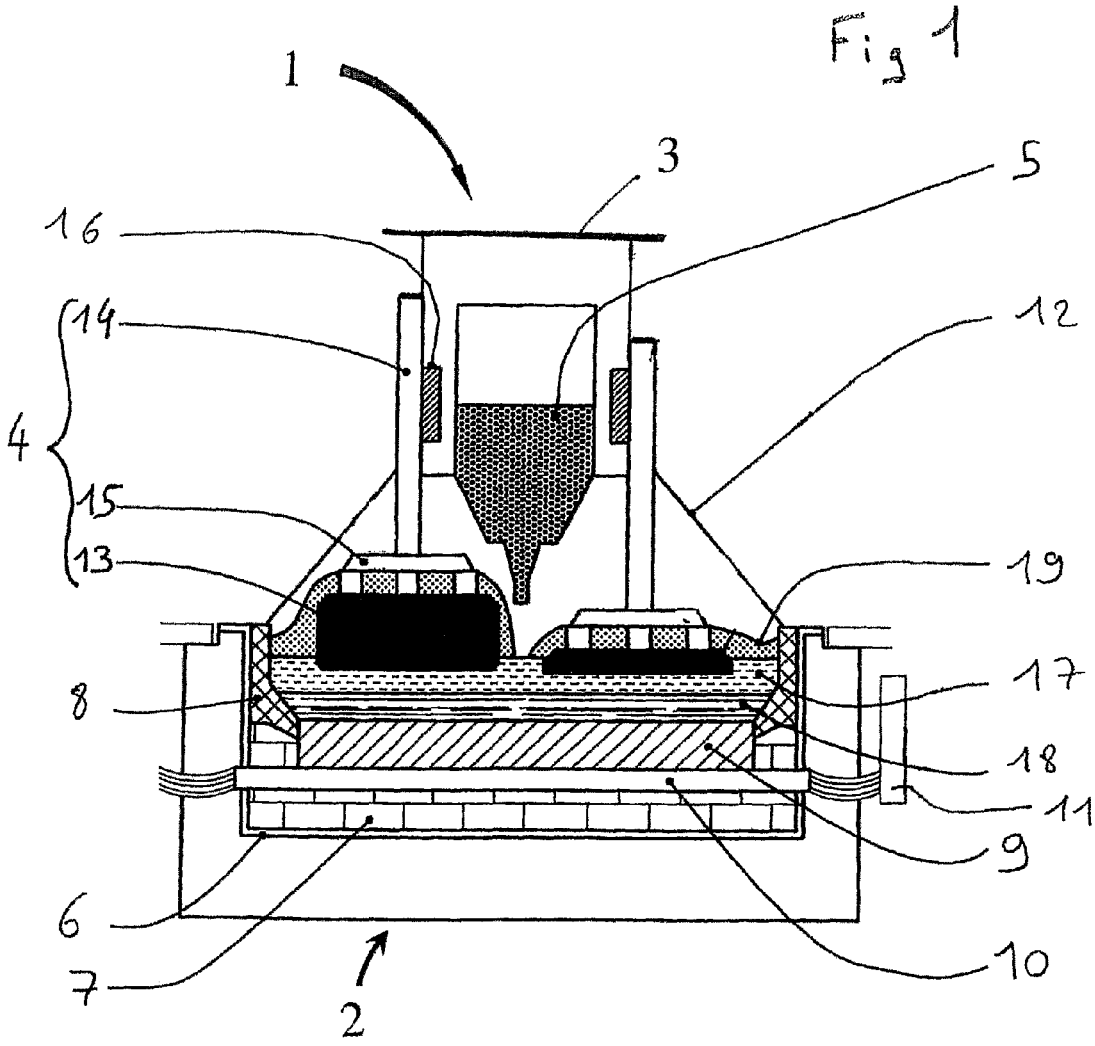
FIG. 1 is a cross-sectional view of a typical electrolysis cell for the production of aluminum.

As illustrated on FIG. 1, an electrolysis cell 1 includes a cell 2, a support structure 3, called "superstructure", carrying a plurality of anodes 4, means 5 to supply the cell with alumina and/with $AlF_3$ and means 12 to recover the effluents emitted by the cell when in operation. Cell 2 typically includes a steel pot shell 6 lined internally with refractory materials 7, 8, a cathode unit which includes blocks made of carbonaceous material 9, called "cathode blocks" laid out in the bottom of the cell, and metal connection bars 10 to which electric conductors 11 are fixed used to supply the electrolysis current. Anodes 4 each comprise at least one consumable anode block 13 made of pre-baked carbonaceous material and a metal rod 14. The anode blocks 13 have are typically substantially parallelepipedic in shape. The rods 14 are typically fixed to the anode blocks 13 via fasteners 15, generally called "multipodes", comprising pins which are anchored in the anode blocks 13, generally via recesses 36 in the upper face of the anode block. Anodes 4 are fixed so as to be removable onto a mobile metal framework 16, called an "anode frame", by mechanical means of fixing. The anode frame 16 is supported by superstructure 3 and is fixed to electric conductors (not illustrated) used to supply the electrolysis current.

The refractory materials 7, 8 and the cathode blocks 9 form, inside cell 2, a crucible able to contain an electrolyte bath 17 and a layer of molten metal 18 when cell 1 is in operation. In general, a blanket 19 of alumina and solidified bath covers the electrolyte bath 17 and all or part of the anode blocks 13.

Anodes 4, and specifically the anode blocks 13, are partially immersed in the electrolyte bath 17, which contains dissolved alumina. The anode blocks 13 initially each have a typically mainly plane lower face, parallel to the upper surface of the cathode blocks 9, which is generally horizontal. The distance between the lower face of the anode blocks 13 and the upper surface of the cathode blocks 9, known as the "interpolar distance", is an important parameter for regulating the electrolysis cells 1. The interpolar distance is generally controlled with a high degree of accuracy.

The carbonaceous anode blocks are gradually consumed during use. In order to compensate for this wear, it is current practice to gradually lower the anodes by moving the anode framework regularly downwards. In addition, as illustrated in FIG. 1, the anode blocks are generally at different stages of wear, advantageously to avoid having to change all the anodes at the same time.

Figure 2B:
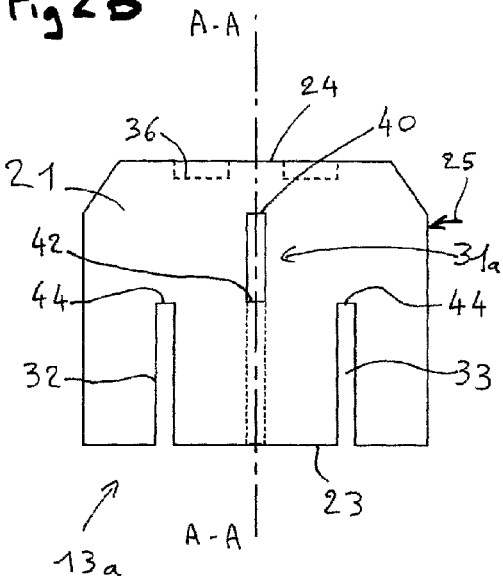
FIGS. 2A and 2B give a front view of an embodiment of an anode block according to the invention.
Figure 2A:
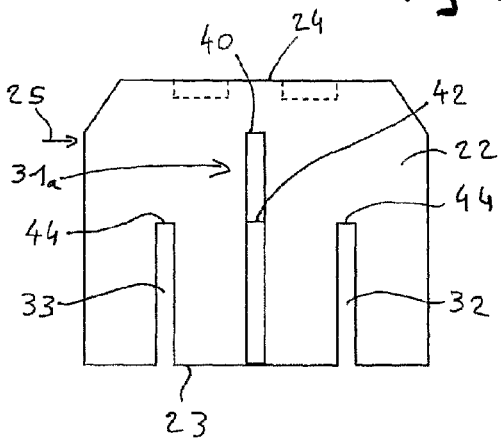
Figure 3:
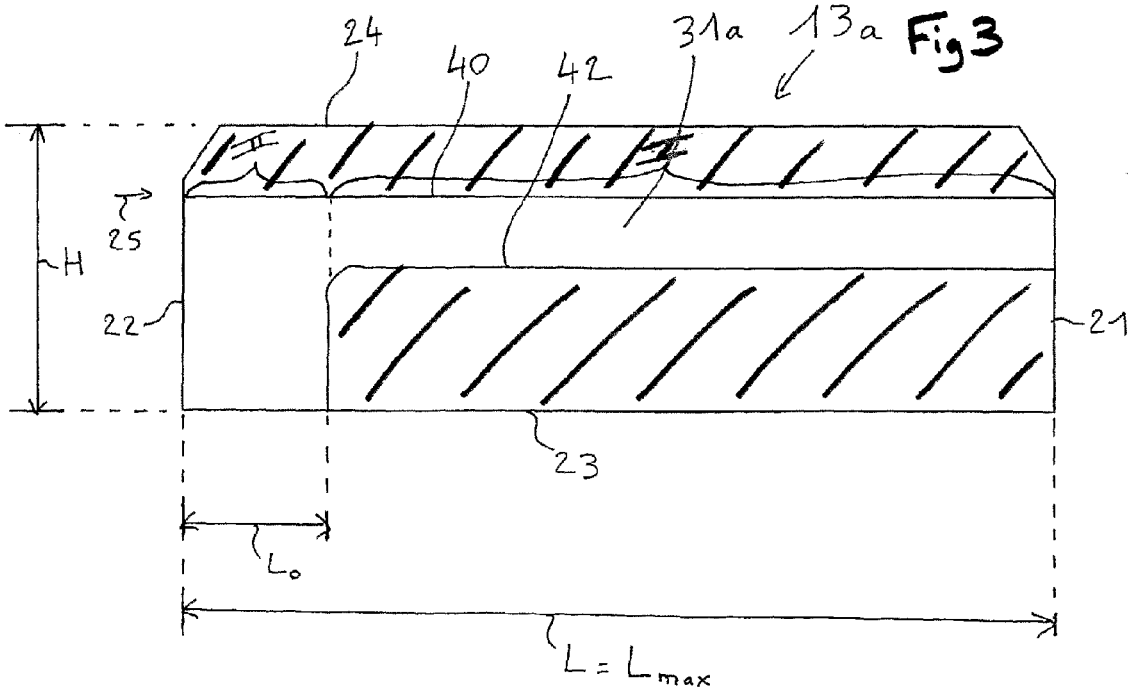
FIG. 3 shows a cross-section of the anode block in FIGS. 2A and 2B along section A-A to highlight the shape of the first groove.

FIGS. 2A, 2B and 3 show a first embodiment of an anode block 13*a* according to the invention. The anode block 13*a* is typically of right-angled parallelepipedic shape of length L between two opposite short side faces 21 and 22 typically vertical and of height H between a typically horizontal lower face 23 and a higher face 24. As shown in FIGS. 2A, 2B and 3, the higher edges can be cut away to limit carbon losses. The anode blocks are designed to be consumed down to a maximum wear height indicated by arrows 25.

The anode block 13*a* comprises a first groove 31*a* and two second grooves 32 and 33.

The second grooves 32, 33 typically pass right through the anode block in the direction of length L. FIGS. 2A and 2B, which shows the short opposite side faces 21, 22 of the anode block 13*a*, show that these second grooves 32, 33 lead onto the lower face 23 throughout its length and onto the two short side faces. Consequently, the second grooves 32, 33 lead onto the lower face 23 over lengths $L'_0$ equal to their respective maximum lengths $L'_{max}$ and also equal to L. In cases where the lower edges are cut away, these lengths $L'_{max}$, and $L'_0$ are also substantially equal owing to the fact that the cut away part is not significant.

To make the figures easier to understand, the scales are not strictly respected in the figures, in particular with regard to the width of the grooves, the width of the grooves typically ranging between 5 and 40 mm while the width of the anode blocks, corresponding to the short side faces generally ranges between 550 and 700 mm. In FIGS. 2A, 2B (and also in FIGS. 8A and 8B) dotted lines are used to show the non visible parts of the faces that are seen by transparency. FIG. 3 is a view of the anode along section A-A through the first groove 31 in order to show more specifically the shaped of the first groove 31.

The first groove 31*a* comprises over its length:

a first portion I forming a perforation or a recess in the heart of the carbonaceous material and not leading onto the lower face 23 of the anode block 13*a;* a second portion II leading to the lower face 23 of the anode block 13*a*.

So when the anode block 13*a* is whole, the first groove 31*a*, shaped like an L lying on its side and includes, on the first portion I, a bottom 40 and a lower wall 42 and only the bottom 40 on the second portion II.

The first groove 31*a* leads onto the two short side faces 21, 22 of anode block 13*a* for removal of the gas building up under the anode. The maximum length $L_{max}$ of the first groove 31*a* in a plane parallel to the lower face is therefore equal to the length L of the anode. The first groove 31*a*, in contrast, leads onto the lower face 23 over a length $L_o$ that is short in relation to the maximum length. To preserve physical intactness and sufficient resistance for the anode block while maintaining significant gas drainage properties, the applicant considers that $L_o$ must be less than half of $L_{max}$ and preferably less than 25% of $L_{max}$ and preferably still less than 10% of $L_{max}$.

The first groove 31*a* extends in parallel and halfway between second grooves 32, 33 so as to preserve the physical intactness and resistance of the anode block 13*a* as much as possible.

As can be seen in FIGS. 2A and 2B, the second grooves 32, 33 have a bottom 44 laid out at the same height in the anode block 13*a* as the lower wall 42 of the first groove 31*a*. So when the second grooves 32, 33 are worn and disappear, the first portion I of the first groove takes over, allowing gases to be removed.

The anode block 13*a* and the anode formed from this anode block 13*a* allow effective continuous removal of gases formed in the electrolysis cell.

Dotted lines in FIG. 2A, 2B show recesses 51 forming sites inside which the pins of the "multipodes" can fit. In this example, the anode block 13*a* specifically shows six cavities 36 laid out in two lines. These recesses are moreover very shallow and consequently have little impact on the intactness of the anode block structure.

The existence of the second portion II of the first groove 31*a*, which leads onto the lower face of the anode designed to be laid out opposite a higher face of a cathode laid out in the bottom of the electrolysis cell is dictated by an adapted version of the conventional method for manufacturing anode blocks. As this second portion II is a source of anode block embrittlement, it is attempted to decrease its length and therefore its impact so that the invention is limited to anode blocks in which the length Lo is less than half of $L_{max}$, and preferably less than 25% of $L_{max}$ and preferably still less than 10% of $L_{max}$.

A conventional way of manufacturing a grooved anode block involves introducing the material that makes up the anode block into a mold of globally parallelepipedic shaped and comprising one or more blades fixed into the bottom of the mold to form the grooves by complementarity. The material of the anode block is then packed by pressurizing or vibrocompacting, the side faces of the mold raised and the anode block pushed beyond the bottom of the mold. During pushing, the anode block is more particularly made to slip in relation to the blades. According to a variant, the blade is withdrawn before pushing.

Figure 4:
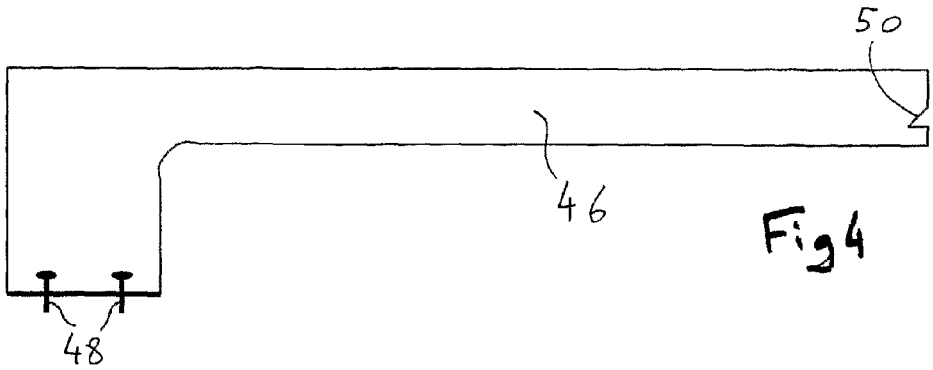
FIG. 4 is a front view of a blade designed to be fixed into a mold to form the first groove during the manufacture of the crude anode block in FIGS. 2 and 3.

FIG. 4 shows a blade 46 used to obtain in a vibrocompactor a first groove 31*a* according to the invention. This blade 46 comprises more specifically a means 48 for fixing the blade into the bottom of the mold. This means 48 for fixing is more specifically made up of screws. The portion of the blade used for this fixing corresponds more specifically to the second portion II of the first groove 31*a*.

As can be seen in FIG. 4, blade 46 may additionally comprise, for example, a notch 50 complementary to a reversible means of fixing provided in a side face of the mould. Although optional, this fixing at an end opposite to means 48 for fixing blade 46 in the bottom of the mold allows the blade to be held properly in the mold, especially with regard to vertical and/or lateral movement. Maintaining the blade this way allows an improvement of the quality of the anode production, particularly a reduction of the cracking rate of the anodes during the cooking, and an increase of the life-time of the blade that is less subject to flex. When removing the anode block 13*a* from the mold, the reversible means of fixing of notch 50 is disengaged, the side faces of the mold are raised and the anode block is slid in relation to blade 46.

Additionally, the blade can advantageously be fixed with regard to a lateral face of the mold at the end of the blade proximal to the means 48 for fixing blade 46. The use of such second reversible means for fixing, that can for example be constituted by a groove provided in the lateral face of the mold and in which the end of the blade slide and stay in place, limits also the move, deformation and wear of the blade.

According to a variant of the manufacturing process, blade 46 can be raised in a removable way in the mold so that blade 46 can be withdrawn from anode block 13*a* before anode block 13*a* is pushed out of the mold.

Figure 5:
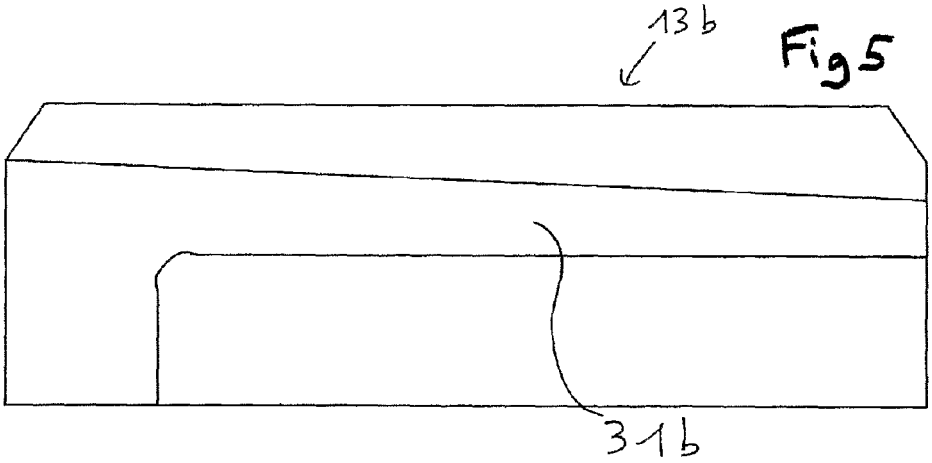
FIGS. 5 to 7 are cross-sections like those in FIG. 3, showing other special shapes for first grooves.

FIG. 5 shows another anode block 13*b* with a first groove 31*b* comprising a bottom 40 tilted in relation to the horizontal so as to improve the speed of gas removal and to encourage gas to be removed to a particular point in the electrolysis cell. The slope of bottom 40 in relation to the horizontal more specifically ranges between 1 and 10°.

Figure 6:
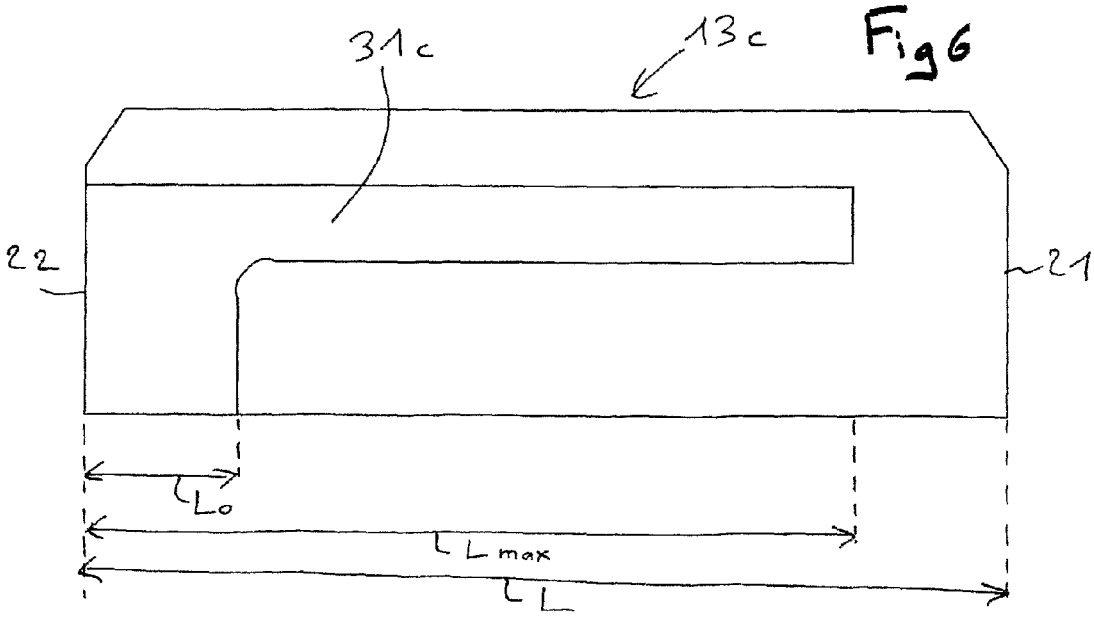

In FIG. 6 another anode block 13*c* is shown, with a first groove 31*c* having a maximum length $L_{max}$ in a plane parallel to the lower face shorter than length L of anode block 13*c* and leading onto a single side face 22 of anode block 13*c*. Length $L_o$ of the first groove 31*c* leading onto the lower face 23 is less than half of $L_{max}$ to preserve the physical intactness and the resistance of the anode block while maintaining significant gas drainage properties.

Figure 7:
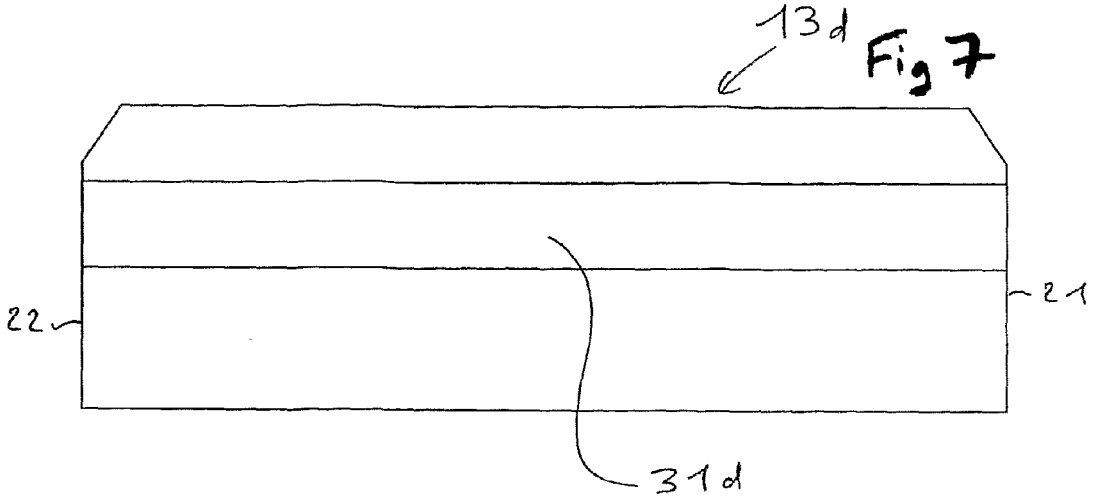

FIG. 7 shows another anode block 13*d* with a first groove 31*d* extending through the material of anode block 13*d* between the two opposite short side faces 21, 22 without leading onto the lower face 23 of anode block 31*d*. Such a first groove 31*d* is particularly advantageous because it does not influence the integrity of the anode block at the level of the lower face 23. The blade inserted into the vibrocompactor mold for molding the anode block is then attached to the side faces of the mold and not to the bottom of the mold. The opposed lateral faces of the mold can for example be provided with two holes in the shape of slots through which the blade is slid, maintained in suspension and fixed by means of locking devices. A placing and retracting cylinder associated to a gripping means of the blade can be used to put the blade in place in the mold before the loading of the carbonaceous materials that make up the anode block and to retract the blade of the raw compacted anode block and of the mold before unloading of the mold.

The invention also extends to an anode block comprising only one or more first grooves, without second grooves. The structural intactness of the anode block will then be similar to an anode block without grooves and improved gas removal will be obtained during the period when the first groove(s) will lead onto the lower face over a significant length.

The invention is not limited to embodiments described above but extends to all the embodiments readily available to experts in the field in the light of the information given above.

The bottom of the second grooves and the lower wall of the first groove can, for example, be provided at slightly different heights so that the first and second grooves coexist for a certain amount of time or, on the contrary, so that there is a period of time without any effective groove after the second groove has worn down and the first groove effectively appears. The number of first and or second grooves may vary, as may their respective positioning and/or respective orientation.

Figure 8B:
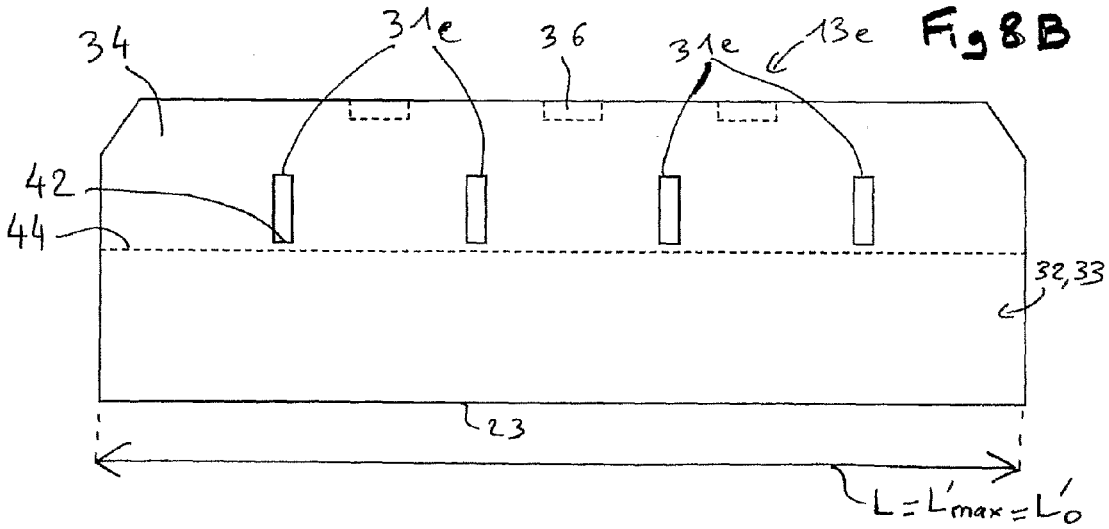
FIGS. 8A and 8B respectively give a front view of another embodiment of an anode block according to the invention.
Figure 8A:
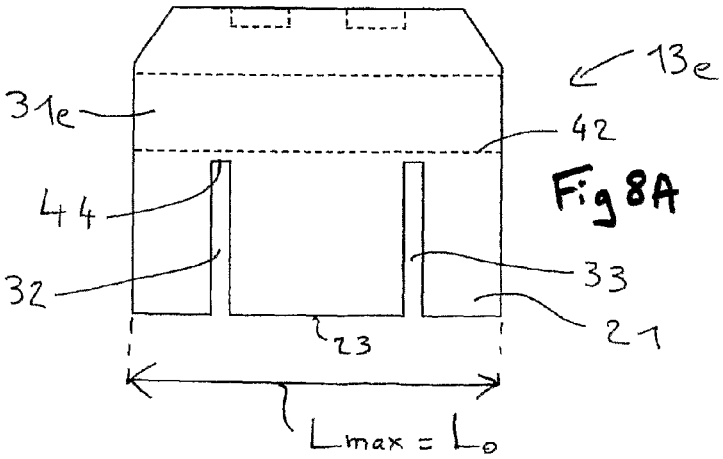

Another anode block 13*e* is therefore shown in FIGS. 8A and 8B as a front view along the short side face 21 and a long side face 34 respectively. The anode block 13*e* comprises two second grooves 32, 33 extending longitudinally and four first grooves 31*e* extending laterally and not leading onto the lower face 23. The first grooves 31*e* therefore extend transversely to the second grooves 32, 33. The bottom 44 of the second grooves is advantageously laid out below the lower wall 42 of the first grooves 31*e*, which prevents weakening the resistance of anode block 13*e* by intersections of the various grooves.

Depending on variants of the invention, a second groove can be taken to mean any groove of a type known from prior art, leading onto the lower face over a length equal or substantially equal to their maximum length. The second grooves may in particular be of the type known from the documents of patent WO 2006/137739 or U.S. Pat. No. 7,179,353.

The invention claimed is:

1. An anode block made of carbon for a pre-baked anode for use in a metal electrolysis cell comprising a higher face, a lower face, configured to be laid out opposite a cathode higher face, and four side faces, and including at least one first groove leading onto at least one of the side faces, in which the first groove has a maximum length $L_{max}$ in a plane parallel to the lower face, and characterized in that the first groove does not lead onto the lower or higher faces, or leads onto said lower or higher faces over a length $L_0$ less than half the maximum length $L_{max}$.

2. An anode block according to claim 1, in which the first groove leads onto two opposite sides faces of the anode block.

3. An anode block according to claim 1, comprising at least one second groove of maximum length $L'_{max}$ in a plane parallel to the lower face and leading onto the lower face over a length $L'_0$ substantially equal to $L'_{max}$.

4. An anode block according to claim 3, comprising two second grooves and a first groove, in which the first and the second grooves extend in parallel in the longitudinal direction from the anode block and in which the first groove is laid out halfway between the two second grooves.

5. An anode block according to claim 1, comprising a plurality of first grooves.

6. An anode block according to claim 1, in which the first groove does not lead onto said lower or higher faces.

7. An anode block according to claim 1, in which the first groove leads onto the lower face over a length $L_0$ less than half the maximum length $L_{max}$.

8. An anode block according to claim 7, in which the length over which the first groove leads onto the lower face is less than 25% of the maximum length $L_{max}$.

9. An anode block according to claim 8, in which the length over which the first groove leads onto the lower face is less than 10% the maximum length $L_{max}$.

10. A pre-baked anode comprising at least one anode block according to claim 1.

11. A cell for the production of aluminum by igneous electrolysis comprising a plurality of anodes, characterized in that at least one of the anodes is an anode according to claim 10.

12. A process for the manufacture of aluminum including stages comprising:

providing at least one pre-baked anode comprising at least one anode block made of carbon for use in a metal electrolysis cell comprising a higher face, a lower face, configured to be laid out opposite a cathode higher face, and four side faces, and including at least one first groove leading onto at least one of the side faces, in which the first groove has a maximum length $L_{max}$ in a plane parallel to the lower face, and characterized in that the first groove does not lead onto the lower or higher faces, or leads onto said lower or higher faces over a length $L_0$ less than half the maximum length $L_{max}$;

fitting the anode in an aluminum electrolysis cell above a cathode;

sending current into the electrolysis cell through the anode;

recovering the aluminum obtained by electrolysis in the bottom of the electrolysis cell.

13. A process for the manufacture of an anode block made of carbon for a pre-baked anode for use in a metal electrolysis cell comprising a higher face, a lower face, configured to be laid out opposite a cathode higher face, and four side faces, and including at least one first groove leading onto at least one of the side faces, in which the first groove has a maximum length $L_{max}$ in a plane parallel to the lower face, and characterized in that the first groove does not lead onto the lower or higher faces, or leads onto said lower or higher faces over a length $L_0$ less than half the maximum length $L_{max}$, the process comprising:

inserting a blade inside a vibrocompactor mold;

loading the vibrocompactor mold with carbonaceous materials that make up the anode block;

vibrocompacting the carbonaceous materials; and removing the anode block thus formed from the mold.

14. A process according to claim 13, in which the blade is withdrawn from the mold before removing the anode block.

15. A process according to claim 13, in which the anode block is removed by slippage in relation to the blade.

16. A process according to claim 13, in which the blade is fixed to the bottom of the mold.

17. A process according to claim 13, in which the blade is fixed to one lateral face or two opposed lateral faces of the mold before loading.

* * * * *